United States Patent [19]

Jessop et al.

[11] 4,416,711

[45] Nov. 22, 1983

[54] PERCHLORATE SLURRY EXPLOSIVE

[75] Inventors: Harvey A. Jessop, Lehi; Albert G. Funk, Salt Lake City, both of Utah

[73] Assignee: IRECO Chemicals, Salt Lake City, Utah

[21] Appl. No.: 450,647

[22] Filed: Dec. 17, 1982

[51] Int. Cl.[3] ..... C06B 33/06

[52] U.S. Cl. ..... 149/42; 149/44; 149/83; 149/85

[58] Field of Search ..... 149/83, 85, 42, 44

[56] References Cited

U.S. PATENT DOCUMENTS

| | | | |
|---|---|---|---|
| 3,453,158 | 7/1969 | Clay | 149/83 X |
| 3,457,126 | 7/1969 | Travers et al. | 149/83 X |
| 3,507,718 | 4/1970 | Mortensen et al. | 149/83 X |
| 3,617,402 | 11/1971 | Knight | 149/83 X |
| 3,765,967 | 10/1973 | Funk | 149/83 X |
| 3,886,010 | 5/1975 | Thornley et al. | 149/85 X |
| 3,899,374 | 8/1975 | Sylkhouse | 149/21 X |
| 3,925,123 | 12/1975 | Jessop | 149/85 X |
| 3,940,297 | 2/1976 | Bolza | 149/85 X |
| 4,104,092 | 8/1978 | Mullay | 149/85 X |
| 4,140,561 | 2/1979 | Keith | 149/85 X |
| 4,149,916 | 4/1979 | Wade | 149/83 X |
| 4,207,125 | 6/1980 | Grant | 149/44 X |
| 4,380,482 | 4/1982 | Sandell | 149/2 X |

*Primary Examiner*—Stephen J. Lechert, Jr.

[57] ABSTRACT

The present invention relates to improved explosive compositions of the aqueous slurry type. More particularly, the invention relates to explosive compositions containing sodium perchlorate, polysaccharide polymer of plant origin, water, and preferably, gassing and cross-linking agents and particulate sensitizers such as finely divided aluminum. These compositions have improved physical and detonation properties over prior art compositions, and in addition, they form excellent "permissible" explosive compositions, even though sodium perchlorate is present.

13 Claims, No Drawings

PERCHLORATE SLURRY EXPLOSIVE

BACKGROUND OF THE INVENTION

Slurry explosives compositions have achieved wide acceptance as commercial explosives owing to their relative low cost, safety and inherent water-resistance. These explosives generally contain a continuous liquid phase comprising an inorganic oxidizer salt solution, a thickening agent for the liquid phase, water and/or water-miscible liquid organics, particulate fuel and/or sensitizer, and, optionally, trace ingredients such as gassing and cross-linking agents. These compositions can have varying rheology and generally can be pumped as fluids at least initially after formulation. They can be used successfully in water-containing boreholes due to their water-resistance.

A specialized use of slurry explosive compositions is in the permissible explosive field. Generally, permissible explosives are those which are cap-sensitive and relatively nonincendive so that they can be used in underground mines having potentially flammable atmospheres, such as underground coal mines. The United States Department of Labor Mine, Safety and Health Administration has established detailed requirements for approval of permissible explosives for underground use. These requirements are published in 30 C.F.R. Part 15. These regulations, which are incorporated herein by reference, define permissible explosives in terms of minimum requirements, which are somewhat stringent. Co-pending application Ser. No. 186,371 discloses a permissible slurry explosive comprising inorganic nitrate oxidizer salts, water, inert material such as sodium chloride, finely flaked aluminum particles and cross-linking and thickening agents. The present invention discloses a permissible explosive composition containing relatively high amounts of sodium perchlorate, which ingredient has been prohibited for use in permissible compositions in the United States and certain other countries. The compositions also contain high amounts of a polysaccharide polymer of plant origin, preferably a starch. This ingredient acts as a thickener and fuel in the composition.

With compositions of the present invention, it is particularly important to prevent leakage or leaching of the sodium perchlorate solution, which becomes highly flammable if allowed to dry in the presence of a fuel such as packaging material. The use of high amounts of polysaccharide polymer is necessary to provide sufficient thickening to prevent leakage or leaching. Others have employed starches or fibrous or pulpy plant matter as thickeners in explosive compositions containing solutions of inorganic oxidizer salts. For example, U.S. Pat. No. 3,507,718 discloses an explosive slurry containing pulpy fibrous matter; however, additional thickeners such as starch or gum generally are required since the cellular materials described in this patent are essentially insoluble on non-hydratable in water, in contrast to the more soluble or hydratable finely divided polysaccharide polymer employed in the present invention. U.S. Pat. No. 3,361,604 discloses an explosive slurry containing plant matter as a combined thickening agent and fuel. The disclosed fibrous pulpy plant matter is similar to that disclosed in U.S. Pat. No. 3,507,718 described above, and thus differs from the polysaccharide polymer of the present invention. Small amounts of polysaccharide polymers have been used in explosive compositions as thickeners. See, for example, U.S. Pat. Nos. 3,713,917; 3,350,246; 3,378,415; and 3,522,117. The present invention, however, requires considerably more polysaccharide polymer. In addition, the present invention requires the specific combination of high amounts of polysaccharide polymer with a sodium perchlorate solution, and none of the prior art references disclose this combination. Although some of the prior art references referred to above suggest that sodium perchlorate may be used as a supplemental oxidizer salt, ammonium nitrate is the principal salt used.

The combination of sodium perchlorate and polysaccharide polymer in the present invention offers several advantages over compositions of the prior art. These advantages include:

1. The use of a high concentration of polysaccharide polymer as a thickener and fuel prevents leaking or leaching of the sodium perchlorate solution from the composition. This minimizes the hazard of using sodium perchlorate. In addition, the use of the polysaccharide polymer as thickener imparts to the composition a tough, rubbery rheology, which minimizes the degree of contact of the composition with foreign materials in the event of spills or accidents. Thus, the flammability hazard is further reduced.

2. The polysaccharide polymers will hydrate in the sodium perchlorate solution at ambient temperature, which is a safe temperature for manufacturing. Many prior art compositions require elevated and thus more hazardous manufacturing temperatures.

3. The compositions retain their sensitivity over a relatively wide density range. The compositions also are relatively temperature insensitive from −20° C. to 30° C. Thus the compositions can be used under many different blasting conditions covering wide extremes of climate or bulk energy needs.

4. The compositions do not require the use of expensive thickening agents such as gums.

5. The compositions for excellent permissible explosives. Upon reaction the sodium perchlorate forms sodium chloride, which acts as a flame retardant for the detonation products. In fact, sodium chloride commonly is added to a permissible explosive for purposes of flame retardation. The in situ formation of sodium chloride from sodium perchlorate is preferable, however, to the separate addition of sodium chloride, since sodium chloride is an inert which reduces the energy of the composition, whereas sodium perchlorate is a reactant. Moreover, the concentration of sodium perchlorate in the compositions of the present invention is preferably about 50%, which produces about 24% sodium chloride in the products of detonation. To add this amount of sodium chloride as an inert would considerably reduce the energy and sensitivity of the composition. The compositions also contain a high water content and require less aluminum for sensitization than do nitrate oxidized slurries. The lower aluminum level and the higher water level further lower incendivity. Finally, the high amount of polysaccharide polymer thickener restricts crystal growth of solid crystals of sodium perchlorate further minimizing incendivity at low temperatures where salts could precipitate from solution. Accordingly, the compositions are excellent for permissible use, even though sodium perchlorate heretofore has been considered too hazardous for permissible use and in fact has been prohibited in certain countries.

A more detailed description of these and other advantages of compositions of the present invention is given in the description that follows.

SUMMARY OF THE INVENTION

The present invention comprises an explosive composition having a continuous aqueous phase of sodium perchlorate solution, which is thickened by high amounts of a polysaccharide polymer, preferably a starch, which acts as a fuel and thickener. Preferably, the composition is sensitized by the addition of finely divided aluminum particles, and its rheology is improved by the addition of a cross-linking agent for the polysaccharide polymer. Preferably a gassing agent or hollow particles are employed to control density and further sensitize the composition.

DETAILED DESCRIPTION OF THE INVENTION

The compositions preferably require, by weight based on the total composition, at least about 35% sodium perchlorate. Minor amounts of other oxidizer salts, such as ammonium nitrate, calcium nitrate and sodium nitrate, may be used but are unnecessary. More preferably, the compositions contain about 50% by weight sodium perchlorate.

The compositions preferably contain, by weight, from about 17% to about 35% water. The more preferred range is from about 20% to about 35%. The preferred ratio of sodium perchlorate to water is about 2 to 1.

The polysaccharide polymer of plant origin preferably is employed in an amount, by weight, of from about 8% to about 25%, and more preferably, from about 15% to about 25%. The polysaccharide polymer should be in a finely divided form and preferably should be hydratable in a sodium perchlorate solution, preferably at ambient temperatures. The polysaccharide polymer of plant origin preferably is selected from the group consisting of potato starch, wheat starch, corn starch, manniock, tamarind seed, tapioca, rice and ground whole grains and mixtures thereof. Other polysaccharide polymers can be used, however, including non-hydratable polymers such as fine sawdust, wood pulp, corncob powder, beet pulp, cactus fiber, alfalfa and castor bean pomace. Non-hydratable polymers thicken the salt solution by absorption and are used in combination with hydratable polymers in such proportions required to obtain desired rheology. The preferred polysaccharide polymer is wheat starch such as Genvis 600 from Henkle Corporation. By selecting the type and particle size of the polysaccharide polymer, the rheology of the explosive composition can be controlled. For example, the hydration rate should allow sufficient time for mixing and pumping before the composition becomes overly viscous. Since the hydration rate is a function of both polymer type and its particle size, the rate can be controlled selectively, as is well-known in the art. Similarly, final rheology is controlled by the amount and type of polymer used.

Preferably, from 0% to about 40% by weight, more preferably, from about 2% to about 8%, finely divided aluminum particles are used to provide sensitization. These particles can be atomized or finely flaked such as paint grade. The finely flaked particles should be fine, have a high surface area and have a hydrophobic surface coating. Generally, finely flaked particles are used to impart cap-sensitivity to the compositions. The atomized particles preferably should be of a particle size less than 250 microns.

Auxiliary fuels and/or sensitizers also may be employed. Examples of solid fuels which can be used are carbonaceous materials such as gilsonite or coal. Liquid or soluble fuels may include either water-miscible or immiscible organics. Miscible liquid or soluble fuels include alcohols such as methyl alcohol, glycols such as ethylene glycol, amides such as formamide, urea, and analagous nitrogen containing liquids. These liquids generally acts as a solvent for the oxidizer salt and, therefore, can replace a portion of the water. Preferably, from about 0.1% to about 5% of a miscible liquid or soluble fuel such as ethylene glycol, formamide, or urea is employed. The use of such fuel reduces the ignitability of the composition or of any leaked sodium perchlorate solution and increases the solubility of sodium perchlorate.

As is well known in the art, gassing agents preferably are employed to lower and control the density of and to impart sensitivity to slurry explosive compositions. The compositions of the present invention preferably employ a small amount, e.g., about 0.01% to about 0.2% or more, of such gassing agent to obtain a composition density of less than about 1.5 gm/cc. The compositions of the present invention preferably have a density of from about 0.85 gm/cc to about 1.3 gm/cc. A preferred gassing agent is a nitrate salt such as sodium nitrite, which decomposes chemically in the solution of the composition to produce gas bubbles. Mechanical agitation of the thickened aqueous phase of the composition, such as obtained during mixing of the aqueous phase and the solid particulate ingredients, will result in the entrainment of fine gas bubbles to produce gassing by mechanical means. Hollow particles such as hollow glass spheres, styrofoam beads and plastic microballons also are commonly employed to produce a gassified explosive composition, particularly when incompressibility is desired. Two or more of these common gassing means may be employed simultaneously.

A cross-linking agent preferably is employed in the compositions of the present invention. Cross-linking agents for cross-linking the polysaccharide polymer are well known in the art. Such agents are usually added in trace amounts and usually comprise metallic ions such as dichromate or antimony ions. Auxiliary thickening agents, such as guar gum, may be used, as desired.

The slurry explosive compositions of the present invention are prepared by first forming a solution of the sodium perchlorate in water (and miscible liquid fuel, if used) at an ambient temperature. To this solution are added the remaining ingredients, which are incorporated into and homogeneously dispersed throughout the solution by a mechanical stirring means as is well known in the art. A cross-linking agent, if used, may be pre-incorporated into the solution or added with the remaining ingredients. The resultant explosive composition may then be transferred or pumped while still fluid into a desired container. Upon hydration of the polysaccharide polymer, the composition generally will become highly viscous and non-flowable.

The present invention can be better understood by reference to a number of examples in the Table below. Example 1 contained no paint-grade aluminum sensitizer and was non-cap-sensitive. Example 2 contained only 2% paint-grade aluminum but was sensitive to a No. 2 blasting cap. Thus, Examples 1 and 2 show that paint grade sensitization is very effective in slurries containing sodium perchlorate and starch. In Examples 2, 3 and 4–8, the sensitivity of the compositions remained essentially constant over a wide density range. Examples 5–8 illustrate that temperature has little effect as well as sensitivity. The fact that sensitivity is relatively unaffected by density and temperature variations is a major advantage of the present invention. The remaining examples illustrate various embodiments of the present invention.

While the present invention has been described with reference to certain illustrative examples and preferred embodiments, various modifications will be apparent to those skilled in the art and any such modifications are intended to be within the scope of the invention as set forth in the appended claims.

1. An explosive composition comprising, by weight based on the total composition:

(a) at least about 35% sodium perchlorate, (b) from about 17% to about 35% water, (c) from about 8% to about 25% polysaccharide polymer of plant origin; and (d) minor amounts of gassing and cross-linking agents.

2. An explosive composition according to claim 1, wherein the polysaccharide polymer of plant origin is selected from the group consisting of potato starch, wheat starch, corn starch, manniock, tamarind seed, tapioca, rice, and ground whole grains and mixtures thereof.

3. An explosive composition according to claim 2, wherein the polysaccharide polymer of plant origin is starch.

TABLE

| Composition | 1 | 2 | 3 | 4 | 5 | 6 | 7 | 8 | 9 | 10 |
|---|---|---|---|---|---|---|---|---|---|---|
| Ingredients (parts by weight) | | | | | | | | | | |
| $NaClO_4$ | 52.0 | 52.0 | 51.9 | 49.3 | 49.3 | 49.3 | 49.3 | 49.3 | 48.8 | 48.3 |
| $H_2O$[1] | 25.2 | 24.2 | 24.2 | 25.5 | 25.5 | 25.5 | 25.5 | 25.5 | 25.1 | 31.2 |
| Ethylene glycol | — | — | — | 0.4 | 0.4 | 0.4 | 0.4 | 0.4 | 0.4 | — |
| Guar gum | — | — | — | 0.2 | 0.2 | — | — | — | — | — |
| Starch | — | 1.0 | 1.0 | — | — | — | — | — | — | — |
| Thiourea | 0.1 | 0.2 | 0.2 | 0.1 | 0.1 | 0.1 | 0.1 | 0.1 | 0.1 | 0.1 |
| Acetic Acid | — | 0.1 | 0.1 | 0.05 | 0.05 | 0.05 | 0.05 | 0.05 | 0.1 | 0.1 |
| Urea | — | — | — | — | — | — | — | — | — | — |
| Potato starch[2] | — | 20.0 | 20.0 | — | — | — | — | — | — | 18.0 |
| Wheat starch | 22.0 | — | — | 21.0 | 21.0 | 21.0 | 21.0 | 21.0 | 15.0 | 1.8 |
| Paint grade aluminum | — | 2.0 | 2.0 | 3.0 | 3.0 | 3.0 | 3.0 | 3.0 | 3.0 | 2.0 |
| Atomized aluminum | — | — | — | — | — | — | — | — | 7.0 | — |
| Cross-linking agent[3] | 0.5 | 0.5 | 0.5 | 0.5 | 0.5 | 0.5 | 0.5 | 0.5 | 0.5 | 0.5 |
| Gassing agent[4] | 0.3 | — | 0.1 | — | — | (as needed to obtain density below) | | | | — |
| Density (g/cc) | 1.00 | 1.35 | 1.17 | 1.35 | 1.2 | 1.1 | 0.9 | 0.8 | 1.23 | 1.34 |
| Results at 5° C. | | | | | | | | | | |
| MB[5] Det/Fail | 8g/#12 | #2/#1 | #2/#1 | #2/#1 | #1/— | #1/— | #2/#1 | #1/— | #1/— | #4/#3 |
| AGS[6], Det/Fail (mm) | — | 100/125 | 100/125 | 100/150 | 150/175 | 150/175 | 150/175 | 100/125 | 200/225 | 25/50 |
| D[7], km/sec | — | 2.8 | 3.0 | 3.0 | 3.3 | 3.0 | 2.6 | 2.5 | 3.5 | — |
| Results at −20° C. | | | | | | | | | | |
| MB, Det/Fail | — | — | — | #8marginal | #2/#1 | #2/#1 | #2/#1 | #2/#1 | — | — |
| AGS, Det/Fail (mm) | — | — | — | — | 125/50 | 150/175 | 150/175 | 100/125 | — | — |
| D, km/sec | — | — | — | 0 | 3.1 | 3.0 | 2.6 | 2.4 | — | — |

| Composition | 11 | 12 | 13 | 14 | 15 |
|---|---|---|---|---|---|
| Ingredients (parts by weight) | | | | | |
| $NaClO_4$ | 48.2 | 41.7 | 48.3 | 48.3 | 31.9 |
| $H_2O$[1] | 31.2 | 35.8 | 24.4 | 24.4 | 16.1 |
| Ethylene glycol | — | 0.4 | — | 5.0 | — |
| Guar gum | — | — | — | — | — |
| Starch | — | — | — | — | — |
| Thiourea | 0.1 | 0.1 | 0.1 | 0.1 | 0.07 |
| Acetic Acid | 0.1 | 0.1 | 0.05 | 0.05 | 0.04 |
| Urea | — | — | 5.0 | — | 3.3 |
| Potato starch[2] | 18.0 | — | — | — | — |
| Wheat starch | 1.8 | 15.4 | 18.0 | 18.0 | 8.0 |
| Paint grade aluminum | 2.0 | 4.0 | 3.0 | 3.0 | 1.4 |
| Atomized aluminum | — | — | — | — | 39.0 |
| Cross-linking agent[3] | 0.5 | 0.5 | 1.0 | 1.0 | 1.0 |
| Gassing agent[4] | 0.1 | — | 0.2 | 0.2 | 0.2 |
| Density (g/cc) | 1.13 | 1.18 | 1.24 | 1.25 | 1.43 |
| Results at 5° C. | | | | | |
| MB[5] Det/Fail | #2/#1 | #12/#8 | #2/#1 | #1/— | #4/#3 |
| AGS[6], Det/Fail (mm) | 50/75 | — | 50/75 | 50/75 | 25/50 |
| D[7], km/sec | 2.8 | 2.1 | 3.6 | 3.2 | — |
| Results at −20° C. | | | | | |
| MB, Det/Fail | — | — | — | — | — |
| AGS, Det/Fail (mm) | — | — | — | — | — |
| D, km/sec | — | — | — | — | — |

[1]Total water includes 10% moisture content of starch
[2]Actual starch less 10% moisture
[3]Sodium dichromate solution
[4]Sodium nitrite solution
[5]Minimum booster (blasting cap number) required for detonation. The first number indicates detonation with the cap listed, and the second number indicates failure with the cap listed.
[6]Air gap sensitivity. The first number indicates detonation across the distance indicated, the second number failure. Charge diameter 32 mm.
[7]Detonation velocity

What is claimed is:

4. An explosive composition according to claim 3, wherein the starch is wheat starch.

5. An explosive composition according to claim 1, wherein the gassing agent is selected from the group which consists of a nitrite salt and hollow particles.

6. An explosive composition according to claim 1, wherein the cross-linking agent is a metallic ion.

7. An explosive composition according to claim 1, additionally containing a water-miscible liquid organic fuel in an amount of from 0.1% to about 5%.

8. An explosive composition according to claim 7, wherein the liquid organic fuel is selected from the group consisting of urea, formamide and ethylene glycol.

9. An explosive composition according to claim 1, additionally containing from 0% to 40% finely divided aluminum particles.

10. A permissible explosive composition comprising:
(a) sodium perchlorate,
(b) water,
(c) polysaccharide polymer of plant origin,
(d) gassing and cross-linking agents, and
(e) finely divided aluminum particles.

11. A permissible explosive composition according to claim 10, comprising by weight based on the total composition:
(a) at least about 35% sodium perchlorate,
(b) from about 17% to about 35% water,
(c) from about 8% to about 25% polysaccharide polymer of plant origin,
(d) minor amounts of gassing and cross-linking agents, and
(e) from about 2% to about 8% finely divided aluminum particles.

12. A permissible explosives composition according to claim 11, wherein the polysaccharide polymer of plant origin is selected from the group consisting of potato starch, wheat starch, corn starch, manniock, tamarind seed, tapioca, rice, and ground whole grains and mixtures thereof.

13. A permissible explosives composition according to claim 11, additionally containing a water-miscible liquid organic fuel in an amount of from 0.1% to about 5%.

* * * * *